US011744385B2

(12) United States Patent
Lai et al.

(10) Patent No.: US 11,744,385 B2
(45) Date of Patent: Sep. 5, 2023

(54) BABY BOUNCING CHAIR

(71) Applicant: TUNG TZU INDUSTRIAL CO., LTD., Tainan (TW)

(72) Inventors: Chin-I Lai, Tainan (TW); Yen-Wen Lai, Tainan (TW); Wei-Jia Lai, Tainan (TW)

(73) Assignee: TUNG TZU INDUSTRIAL CO., LTD., Tainan (TW)

( * ) Notice: Subject to any disclaimer, the term of this patent is extended or adjusted under 35 U.S.C. 154(b) by 0 days.

(21) Appl. No.: 17/721,083

(22) Filed: Apr. 14, 2022

(65) Prior Publication Data

US 2023/0232999 A1 Jul. 27, 2023

(30) Foreign Application Priority Data

Jan. 25, 2022 (TW) ..... 111103161

(51) Int. Cl.
*A47D 13/10* (2006.01)
*A47D 15/00* (2006.01)
*A47D 1/00* (2006.01)

(52) U.S. Cl.
CPC ..... *A47D 13/107* (2013.01); *A47D 1/008* (2013.01); *A47D 15/006* (2013.01)

(58) Field of Classification Search
CPC .... A47D 1/008; A47D 13/107; A47D 13/043; A47D 15/006
See application file for complete search history.

(56) References Cited

U.S. PATENT DOCUMENTS

| | | | | |
|---|---|---|---|---|
| 10,342,361 | B2 * | 7/2019 | Cotirla | A47D 15/00 |
| 2011/0012408 | A1 * | 1/2011 | Lee | A47D 1/10 297/217.4 |
| 2017/0232355 | A1 * | 8/2017 | Healy | A47D 3/001 446/227 |
| 2021/0361078 | A1 * | 11/2021 | Logan | A47D 11/00 |

FOREIGN PATENT DOCUMENTS

| | | | | |
|---|---|---|---|---|
| CN | 105231725 | A * | 1/2016 | |
| CN | 110403399 | A * | 11/2019 | |
| CN | 111938368 | A * | 11/2020 | A47D 1/004 |
| WO | WO-2016125026 | A * | 8/2016 | A47D 1/02 |

* cited by examiner

*Primary Examiner* — Milton Nelson, Jr.
(74) *Attorney, Agent, or Firm* — Muncy, Geissler, Olds & Lowe, P.C.

(57) ABSTRACT

The invention provides a baby bouncing chair, comprising a table, a seat unit, a plurality of chair leg units, a bouncing disc module, a plurality of supporting band units, a first cover plate, a bounce-control module and a limiting fastening piece. Each of the plurality of supporting band units is provided with a limiting rod. The bounce-control module is provided with a plurality of stop blocks. The bounce-control module controls movements of the limiting rods and the plurality of supporting band units in the bouncing disc module by the stop blocks to control the baby bouncing chair to be in a bouncing state or a non-bouncing state.

10 Claims, 10 Drawing Sheets

BABY BOUNCING CHAIR

FIELD OF THE INVENTION

The invention relates to a bouncing chair, in particular to a baby bouncing chair capable of providing standing and bouncing games for toddlers or babies.

BACKGROUND OF THE INVENTION

Stimulation of limbs or the senses provided for toddlers or babies through games is common. The toddlers or the babies are guided to different reactions when stimulated by different toys. A bouncing chair is a common example.

Although conventional bouncing chair has a disc for the toddlers or the babies to stand and move thereon, no elastic element is not arranged on the disc. When the toddlers or the babies stand and move on the disc, the disc only swings horizontally and without up and down bouncing movements. Therefore, there is a need for providing a baby bouncing chair capable for the toddlers or the babies to bounce up and down.

SUMMARY OF THE INVENTION

An objective of the invention is to provide a baby bouncing chair capable for toddlers or babies to bounce either in a sitting posture or in a standing posture.

To achieve the above objective, the invention provides a baby bouncing chair, comprising a table, a seat unit, a plurality of chair leg units, a bouncing disc module, a plurality of supporting band units, a first cover plate, a bounce-control module and a limiting fastening piece. The table comprises a table top surface, a table bottom surface opposite to the table top surface, and a center opening. The seat unit is detachably assembled at the center opening. Each of the plurality of chair leg units is provided with a top end and a bottom end opposite to the top end, wherein each of the top ends of the plurality of chair leg units is assembled with the table bottom surface. The bouncing disc module comprises a bouncing disc top surface and a bouncing disc bottom surface opposite to the bouncing disc top surface, wherein a center of the bouncing disc bottom surface is disposed with a limiting column which is protrudly formed and at least three limiting grooves which surround the limiting column. The at least three limiting grooves surround the limiting column. Each of the plurality of supporting band units is provided with a first fixing end and a second fixing end, wherein each of the first fixing ends is assembled with one of the plurality of chair leg units. Each of the second fixing ends is provided with a limiting rod and a reset-control elastic element which is assembled with the supporting band unit and is adjacent to the limiting rod. The second fixing ends are respectively provided in the at least three limiting grooves. The first cover plate provides a first through hole and a plurality of limiting through holes surrounding the first through hole. The bounce-control module is provided with a side surface adjacent to the first cover plate and a plurality of stop blocks on the side surface. The stop blocks are slidably arranged in the plurality of limiting through holes. The limiting fastening piece assembled with the limiting column. The first cover plate and the bounce-control module are arranged between the limiting fastening piece and the bouncing disc module. The plurality of stop blocks of the bounce-control module penetrate through the limiting through holes and are provided in the at least three limiting grooves.

In one embodiment, the bounce-control module further comprises a second cover plate and a control slider. The plurality of stop blocks are disposed on a side surface of the second cover plate adjacent to the first cover plate. The second cover plate is provided with a second through hole, a limiting cylindrical wall, a switch-control elastic element and a limiting sliding groove, wherein the limiting sliding groove is provided on another side surface of the second cover plate. The second through hole corresponds to the first through hole. The limiting cylindrical wall protrudes orthogonally from the side. The plurality of stop blocks protrude around the limiting cylindrical wall. The switch-control elastic element is provided between the limiting cylindrical wall and the limiting column. The control slider is slidably arranged in the limiting sliding groove and enables the limiting fastening piece to move on the surface of the control slider in a first direction. The switch-control elastic element enables the bounce-control module to move in a second direction.

In one embodiment, the reset-control elastic element is a compression spring. The reset-control elastic element sleeves on the second fixing end of one of the plurality of supporting band units and abuts the limiting rod.

In one embodiment, the reset-control elastic element is a tension spring, one end of the reset-control elastic element is provided on the second fixing end of one of the plurality of supporting band units. An opposite end of the rest-control elastic element is attached to one of the at least three limiting grooves.

In one embodiment, the control slider is provided with a limiting trench and two guide walls. The limiting trench is formed by penetrating through the control slider along the first direction. The guide walls are formed by protrudly formed from opposite sides of the limiting trench along the first direction.

In one embodiment, each of the guide walls further comprises a first positioning surface, a connecting surface and a second positioning surface. The connecting surface is arranged between the first positioning surface and the second positioning surface. A height difference larger than zero is provided between the first positioning surface and the second positioning surface.

In one embodiment, when the limiting fastening piece abuts against the first positioning surface, the plurality of stop blocks penetrate through the plurality of limiting through holes and block the limiting rod from moving in one of the at least three limiting grooves. When the limiting fastening piece abuts against the second positioning surface, the plurality of stop blocks are limited in the plurality of limiting through holes.

In one embodiment, the limiting fastening piece provides a head and a threaded portion protruding from the head. The threaded portion is fastened on the limiting column. A side facing the threaded portion of the head provides a guide surface. The guide surface abuts against the control slider.

In one embodiment, each of the first fixing ends of the plurality of supporting band units is provided with a first buckling piece. Each of the plurality of chair leg units is provided with a first assembling piece. The first buckling pieces are assembled on the first assembling pieces correspondingly.

In one embodiment, the first cover plate is assembled on the bounce-control module and is provided with a plurality of second assembling pieces. The plurality of second assembling pieces protrudes from the first cover plate. The plurality of second assembling pieces surrounds the bounce-control module.

Therefore, the invention provides the effects that:

the invention enables a user to select whether the baby bouncing chair is in a state for bouncing or not in a simple way. The baby bouncing chair is in a non-bouncing state when the guide surface of the limiting fastening piece is located on the first positioning surface. The baby bouncing chair is in a bouncing state when the guide surface is located on the second positioning surface. The first buckling pieces may be disassembled from the first assembling pieces and buckled on the second assembling pieces on the first cover plate for easy storage.

DETAILED DESCRIPTION OF THE PREFERRED EMBODIMENTS

Figure 1:
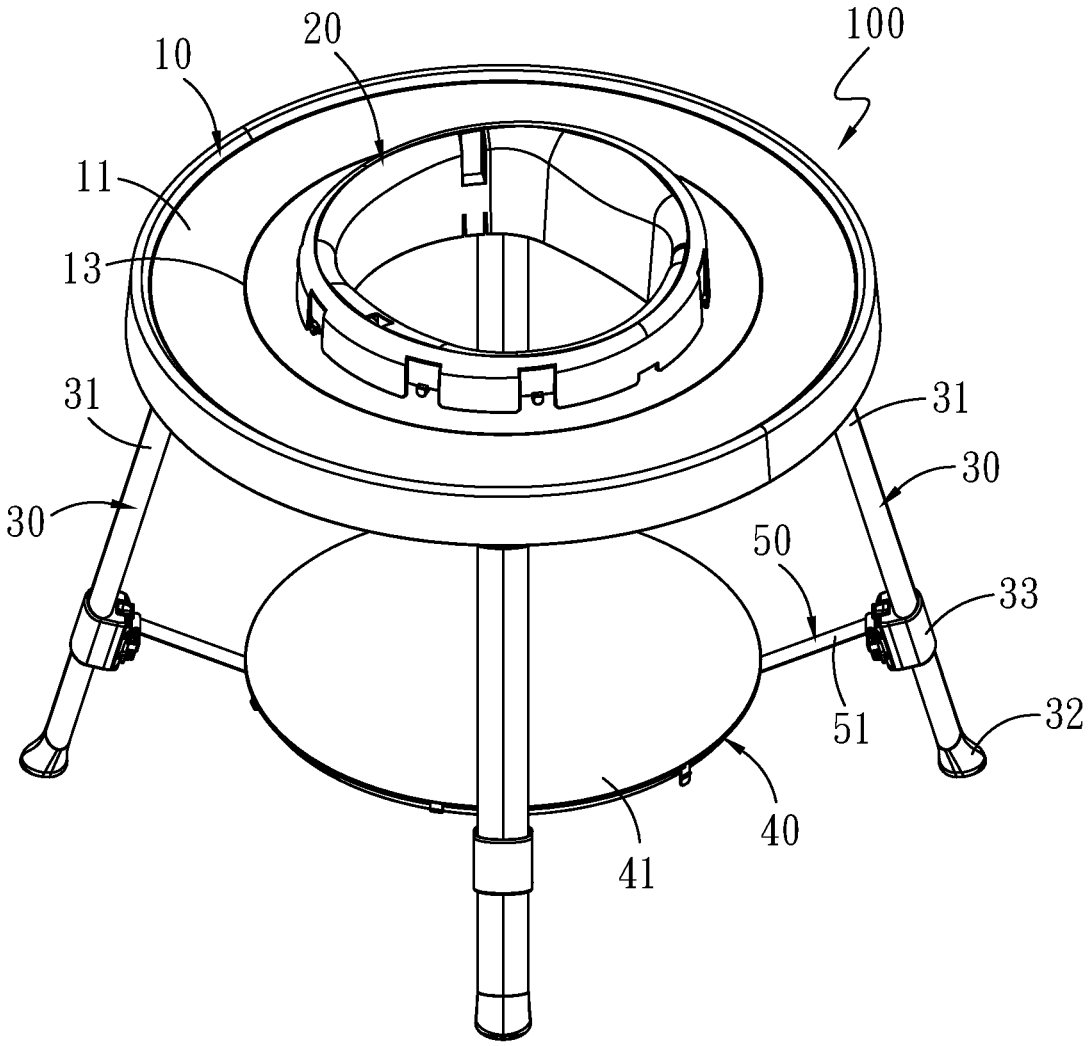
FIG. 1 is a perspective view of a baby bouncing chair of the invention.
Figure 2:
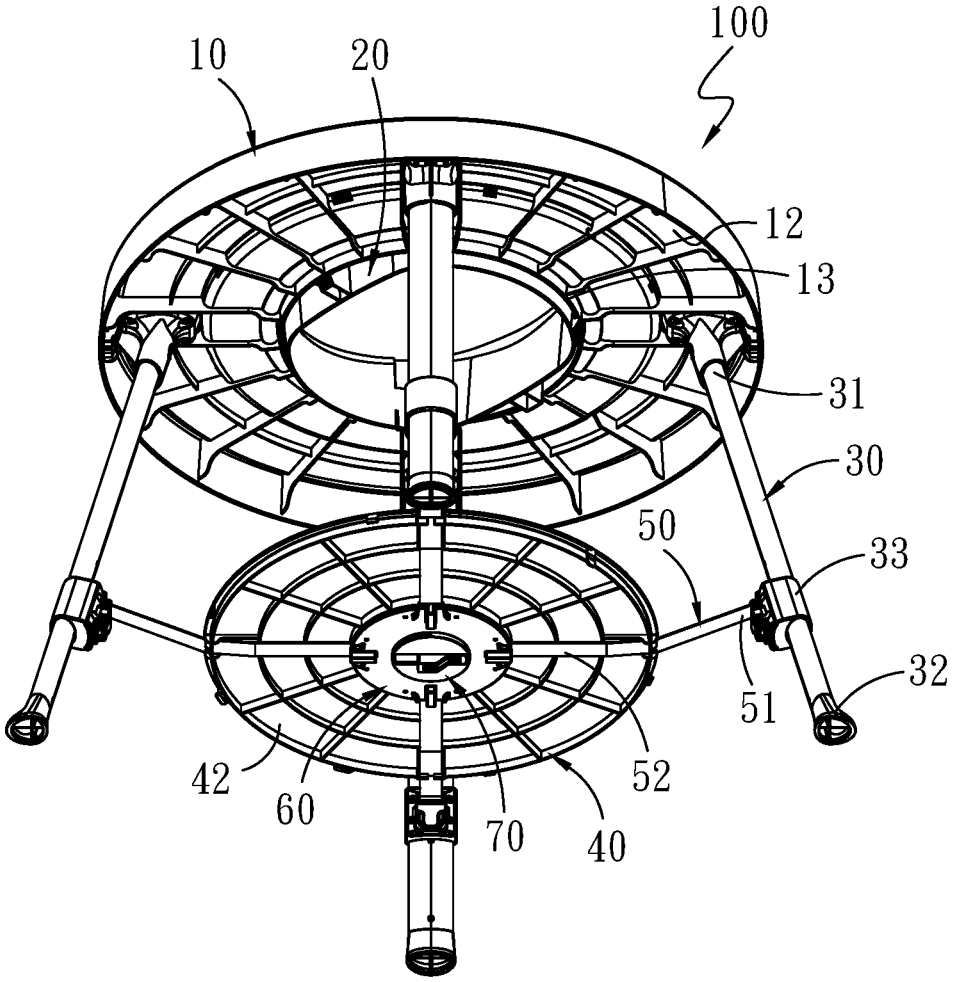
FIG. 2 is a perspective view of a baby bouncing chair of the invention from a different angle.
Figure 3:
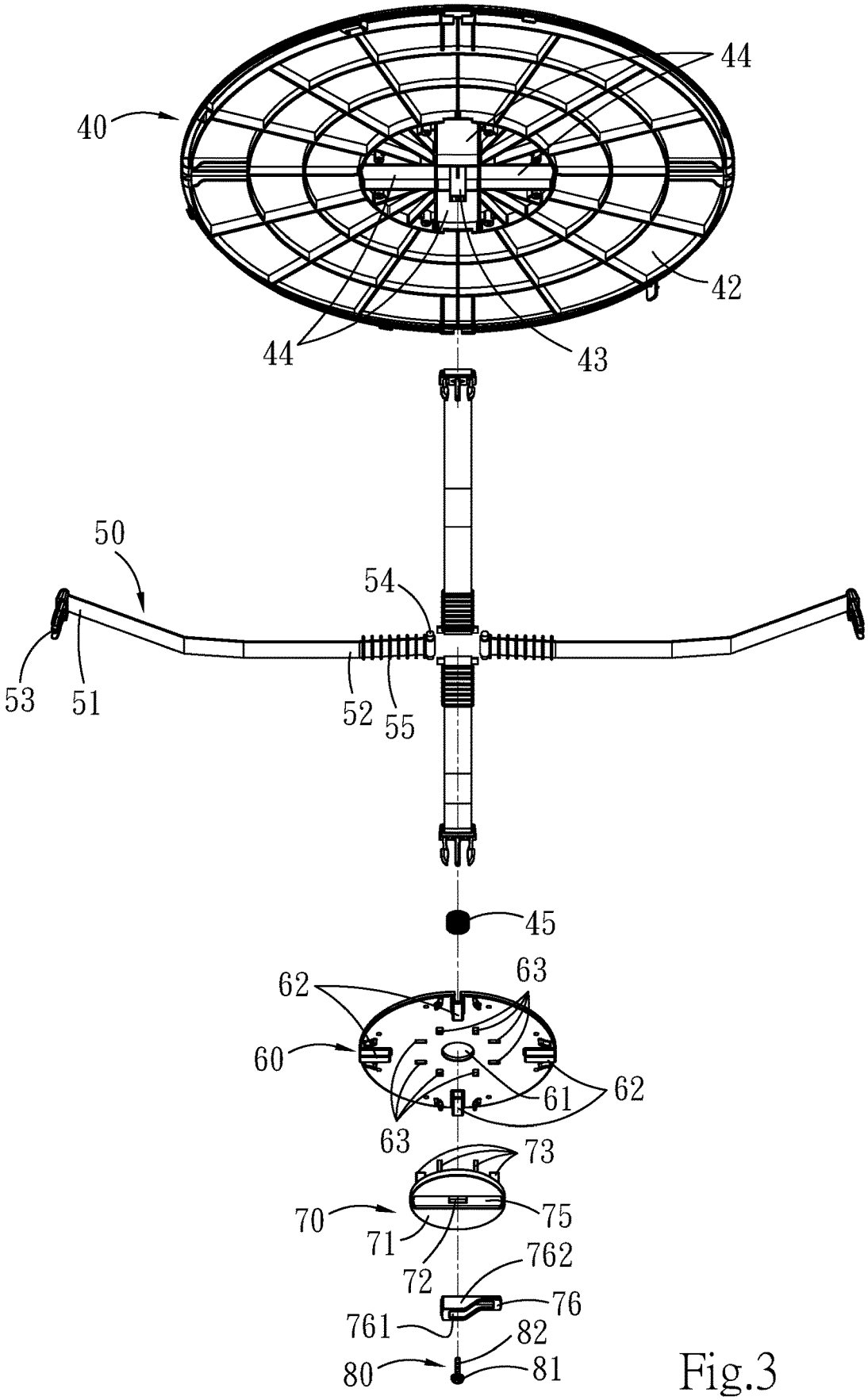
FIG. 3 is a partially exploded perspective view of a baby bouncing chair of the invention.

Referring to FIG. 1, FIG. 2, FIG. 3, FIGS. 4A-D, FIGS. 5A-B, and FIG. 6, the invention discloses a baby bouncing chair 100, comprising a table10, a seat unit 20, a plurality of chair leg units 30, a bouncing disc module 40, a plurality of supporting band units 50, a first cover plate 60, a bounce-control module 70 and a limiting fastening piece 80. The table 10 comprises a table top surface 11, a table bottom surface 12 opposite to the table top surface 11, and a center opening 13.

The seat unit 20 is detachably assembled at the center opening 13.

Each of the plurality of chair leg units 30 is provided with a top end 31 and a bottom end 32 opposite to the top end 31, wherein each of the top ends 31 of the plurality of chair leg units 30 is assembled with the table bottom surface 12. Each of the plurality of chair leg units 30 is provided with a first assembling piece 33.

The bouncing disc module 40 comprises a bouncing disc top surface 41 and a bouncing disc bottom surface 42 opposite to the bouncing disc top surface 41, wherein a center of the bouncing disc bottom surface 42 is disposed with a limiting column 43 which is protrudly formed and at least three limiting grooves 44 surround the limiting column 43. The limiting column 43 is assembled with a switch-control elastic element 45.

Each of the plurality of supporting band units 50 is provided with a first fixing end 51 and a second fixing end 52, wherein each of the first fixing ends 51 is provided with a first buckling piece 53. Each of the first buckling pieces 53 is assembled on a first assembling piece 33 of one of the plurality of chair leg units 30 correspondingly. Each of the second fixing ends 52 is provided with a limiting rod 54 and a reset-control elastic element 55. Each of the reset-control elastic elements 55 is assembled with one of the plurality of supporting band units 50 and is adjacent to the limiting rod 54. Each of the second fixing ends of the supporting band units 50 provided with the limiting rod 54 and assembled with the reset-control elastic element 55 is contained in the corresponding limiting groove 44. In one embodiment, each reset-control elastic element 55 is a compression spring. The reset-control elastic element 55 sleeves on the second fixing end 52 of one of the plurality of supporting band units 50 and abuts against the corresponding limiting rod 54.

The first cover plate 60 is provided with a first through hole 61, a plurality of second assembling pieces 62 and a plurality of limiting through holes 63 surrounding the first through hole 61. The plurality of second assembling pieces 62 protrude from the first cover plate 60. The plurality of second assembling pieces 62 are assembled on a surface of the first cover plate 60 opposite to the bouncing disc module 40 and is buckled with the first buckling pieces 53. The limiting column 43 penetrates through the first through hole 61.

The bounce-control module 70 comprises a second cover plate 71, a second through hole 72, a plurality of stop blocks 73, a limiting cylindrical wall 74, a limiting sliding groove 75 and a control slider 76. The second through hole 72 is formed by penetrating through approximately the center of the second cover plate 71. The plurality of stop blocks 73 are disposed on a side surface of the second cover plate 71 adjacent to the first cover plate 60. The limiting cylindrical wall 74, surrounding the second through hole 72, protrudes orthogonally from the side surface of the second cover plate 71 adjacent to the first cover plate 60. The plurality of stop blocks 73 protrude around the peripheral side of the limiting cylindrical wall 74 and are slidably arranged in the plurality of corresponding limiting through holes 63 of the first cover plate 60. The limiting column 43 penetrates through the second through hole 72. The switch-control elastic element 45 abuts against the second cover plate 71 and is being limited between the limiting column 43 and the limiting cylindrical wall 74. In addition, an another side surface of the second cover plate 71 opposite to the first cover plate 60 is disposed with the limiting sliding groove 75 caved along a radial direction thereof. The control slider 76 is provided in the limiting sliding groove 75 and slides therein. The control slider 76 comprises a limiting trench 761 and two guide walls 762. The limiting trench 761 is formed by penetrating through the control slider 76 along a first direction X. The two guide walls 762 are then protrudly formed from opposite sides of the limiting trench 761 of the control slider 76 along the first direction X. Each of the two guide walls 762 further comprises a first positioning surface 763, a connecting surface 764 and a second positioning surface 765. The connecting surface 764 is arranged between the first positioning surface 763 and the second positioning surface 765. A height difference larger than zero is provided between the first positioning surface 763 and the second positioning surface 765.

The limiting fastening piece 80 is assembled with the limiting column 43. The first cover plate 60 and the bounce-control module 70 are arranged between the limiting fastening piece 80 and the bouncing disc module 40. The limiting fastening piece 80 provides a head 81 and a threaded portion 82 protruding from the head 81. The threaded portion 82 is fastened on the limiting column 43. A side facing the threaded portion 82 of the head 81 provides a guide surface 83. The guide surface 83 abuts against the control slider 76.

The guide surface 83 of the limiting fastening piece 80 abuts against the control slider 76. The control slider 76 controls the limiting fastening piece 80 to move between the first positioning surfaces 763, the connecting surfaces 764, and the second positioning surfaces 765 along the first direction X. The switch-control elastic element 45 enables the second cover plate 71 of the bounce-control module 70 to move along a second direction Y and compress the switch-control elastic element 45. That is, the plurality of stop blocks 73 of the bounce-control module 70 penetrate through the plurality of limiting through holes 63 and are provided in the at least three corresponding limiting grooves 44. The first direction X is different from the second direction Y.

When the limiting fastening piece 80 abuts against the first positioning surfaces 763, the plurality of stop blocks 73 penetrate through the plurality of corresponding limiting through holes 63 and block the limiting rods 54 from moving in corresponding one of the at least three limiting grooves 44. At the same time, the second fixing ends 52 and the limiting rods 54 of the plurality of supporting band units 50 are limited between the plurality of stop blocks 73 and the side walls of the limiting sliding grooves 75 to prevent motion of the plurality of supporting band units 50. Therefore, the bouncing disc module 40 is in the non-bouncing state.

Figure 6:
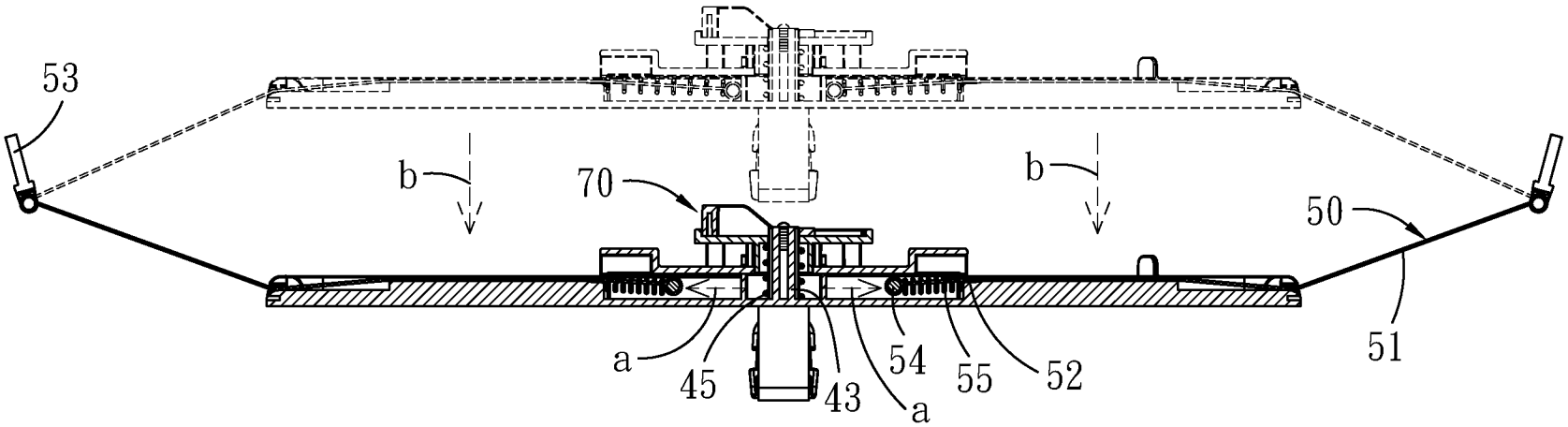
FIG. 6 is a partial perspective view of an operation diagram of up-down movement of a bouncing disc top surface of a baby bouncing chair.

When the limiting fastening piece 80 abuts against the second positioning surfaces 765, the motion of the plurality of stop blocks 73 are limited in the corresponding limiting through holes 63. Hence, the plurality of stop blocks 73 do not block the limiting rods 54. Each of the limiting rods 54 is driven by the corresponding supporting band units 50 to displace in the corresponding limiting grooves 44. As shown in FIG. 6, the limiting rods 54 displace along a direction (labeled as "a"), the limiting rods 54 reciprocally displace in the corresponding limiting grooves 44. The limiting rods 54 displace both unidirectionally and reciprocally by using elastic force of the switch-control elastic element 45. That is, the second fixing ends 52 and the limiting rods 54 of the supporting band units 50 move along the direction (labeled as "a") between the limiting grooves 44 in the reciprocating manner, so that the bouncing disc module 40 is in the bouncing state.

Figure 4A:
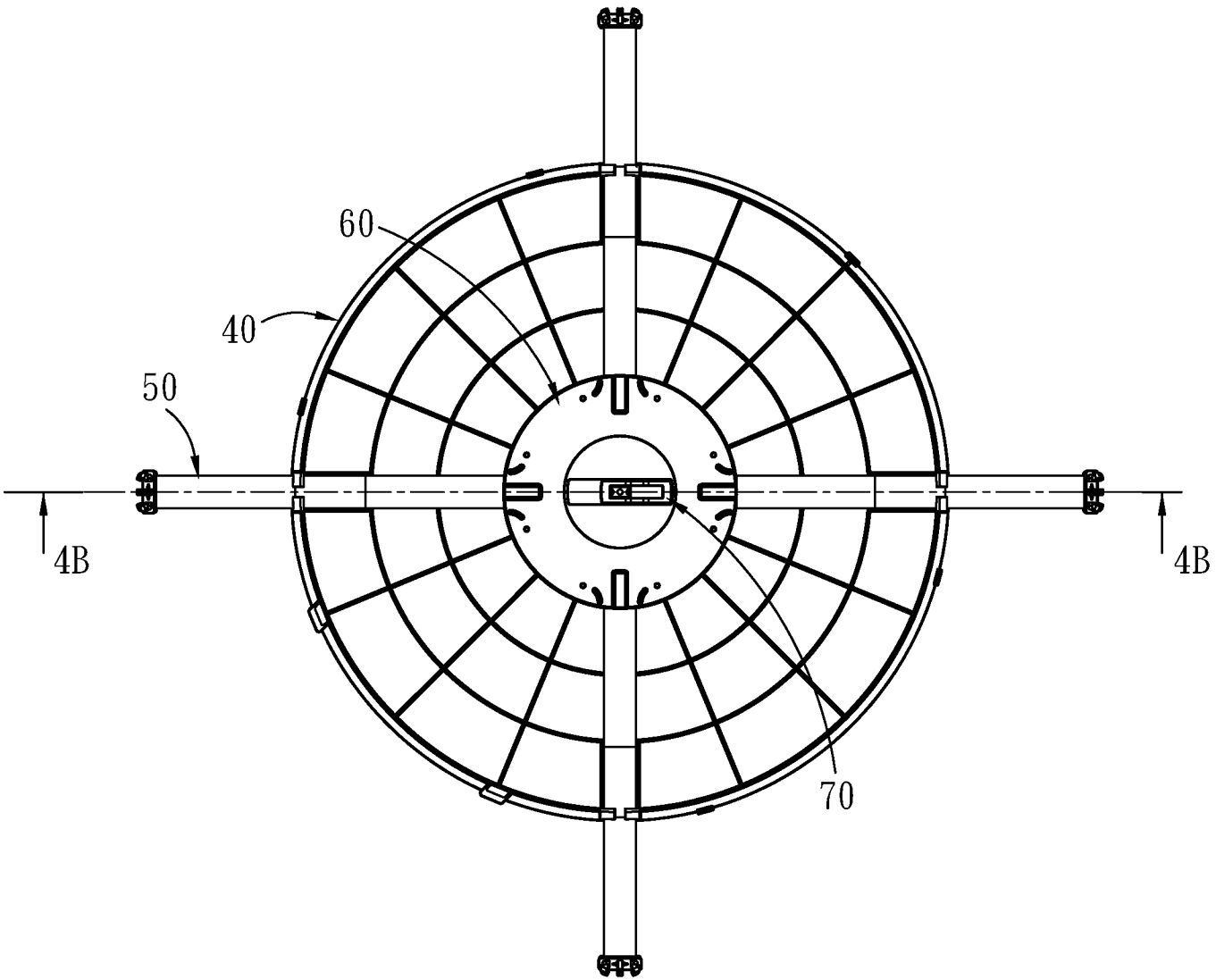
FIG. 4A is a bottom view of a bouncing disc module of a baby bouncing chair of the invention.
Figure 4B:
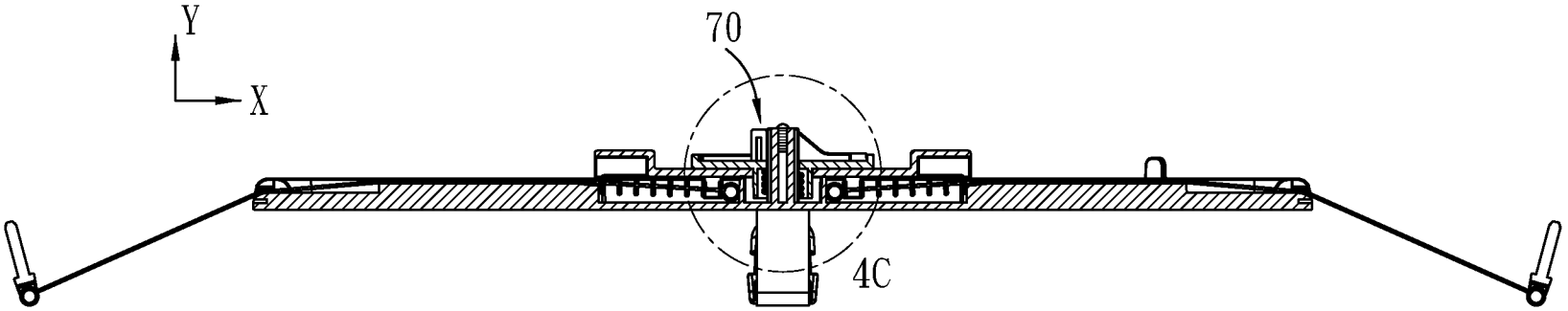
FIG. 4B is an operation section view along line 4B-4B of FIG. 4A that a limiting fastening piece is located on a first positioning surface.
Figure 4D:
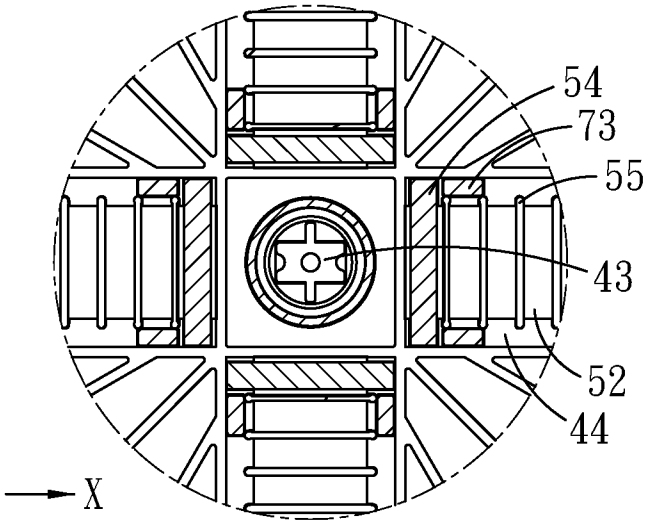
FIG. 4D is a section view taken along line 4D-4D of FIG. 4C.
Figure 4C:
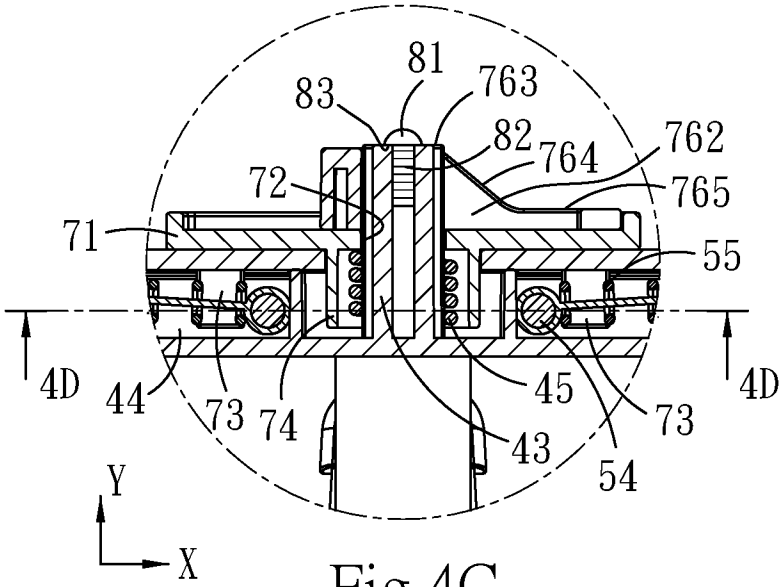
FIG. 4C is an enlarged partial view of circle 4C from FIG. 4B.

Referring to FIG. 1 and FIGS. 4B-D, a user enables the first positioning surfaces 763 of the control slider 76 to abut against the guide surface 83 of the limiting fastening piece 80 to enable the baby bouncing chair 100 to be in the non-bouncing state. Referring to FIGS. 4C-D, the stop blocks 73 of the second cover plate 71 penetrates through the limiting through holes 63 of the first cover plate 60. The limiting rods 54 is blocked between the stop blocks 73 and the walls of the limiting grooves 44. The switch-control elastic element 45 in the limiting cylindrical wall 74 is in a compressed state by the second cover plate 71 and is provided in a containing space formed by the second cover plate 71, the limiting cylindrical wall 74, the limiting column 43 and the bouncing disc bottom surface 42. Therefore, when toddlers or babies jump on the bouncing disc top surface 41, the second fixing ends 52 do not reciprocally move in the limiting grooves 44 as the limiting rods 54 of the second fixing ends 52 are blocked in the limiting grooves 44. The plurality of supporting band units 50 do not drive the bouncing disc module 40 to move up and down.

Figure 5A:
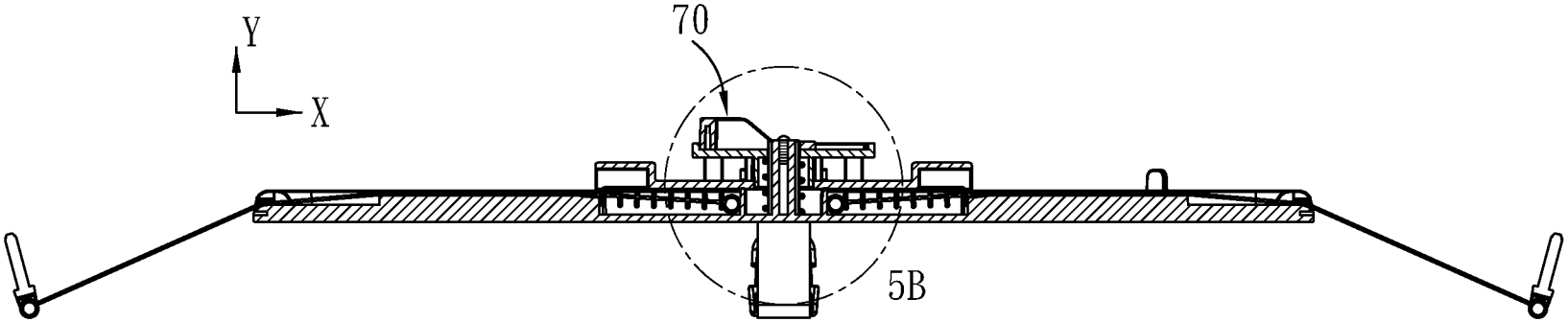
FIG. 5A is an operation section view along line 4B-4B of FIG. 4A that a limiting fastening piece is located on a second positioning surface.
Figure 5B:
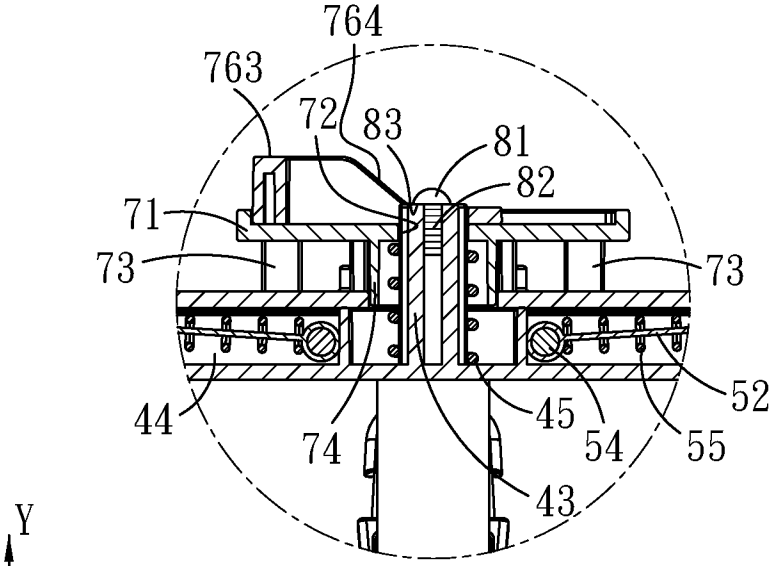
FIG. 5B is an enlarged partial view of circle 5B from FIG. 5A.

Referring to FIGS. 5A-B and FIG. 6, when the user requires the baby bouncing chair 100 to be in the bouncing state, the user pushes the control slider 76 to move in the limiting sliding groove 75 along the first direction. The guide surface 83 of the limiting fastening piece 80 displace from the first positioning surfaces 763, passes through the connecting surfaces 764, and abuts against the second positioning surfaces 765, wherein the height difference is provided between the first positioning surface 763 and the second positioning surface 765. Therefore, the second cover plate 71 is jacked up by elastic restoring force of the switch-control elastic element 45. The plurality of stop blocks 73 of the second cover plate 71 do not block the limiting rods 54, but the plurality of stop blocks 73 are limited in the corresponding limiting through holes 63. When the toddlers or the babies jump on the bouncing disc top surface 41, each of the limiting rods 54 of the second fixing ends 52 are provided with the reset-control elastic element 55, so that the limiting rods 54 drives the supporting band units 50 to reciprocally move along the direction (labeled as "a")in the limiting grooves 44, and the bouncing disc module 40 is enabled to move along a direction (labeled as "b") up and down.

Figure 7:
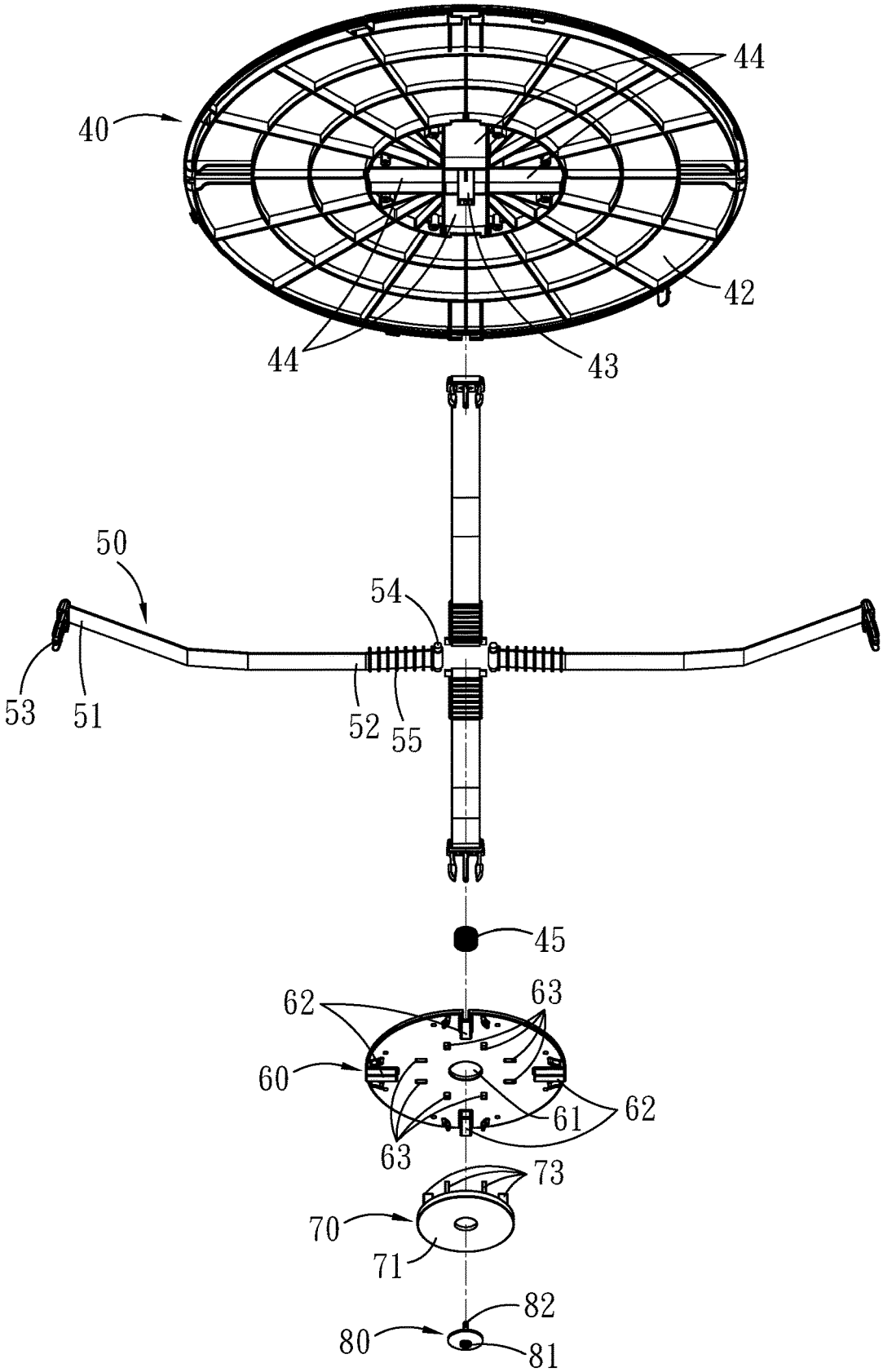
FIG. 7 is a partially exploded perspective view of a baby bouncing chair of another embodiment of the invention.
Figure 8A:
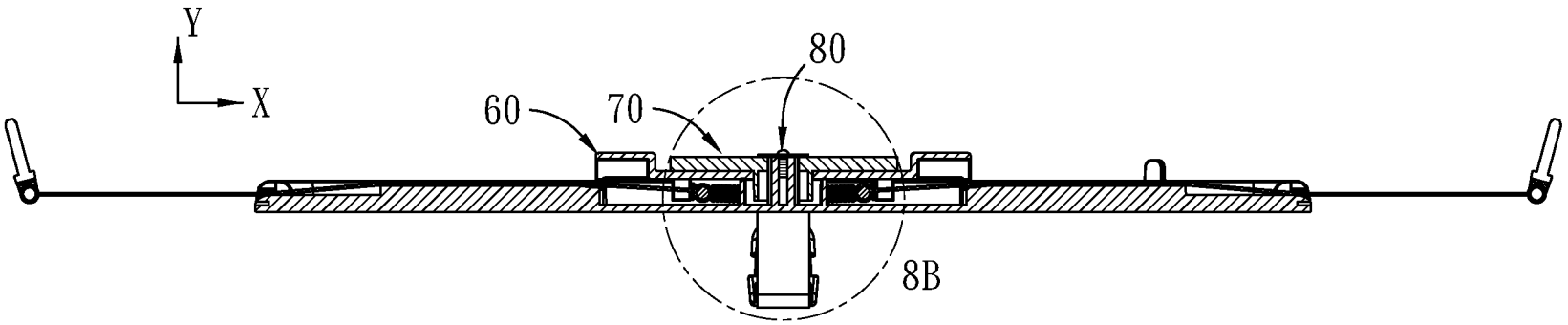
FIG. 8A is a section view that a bounce-control module is fixed to a bouncing disc module of FIG. 7.
Figure 8B:
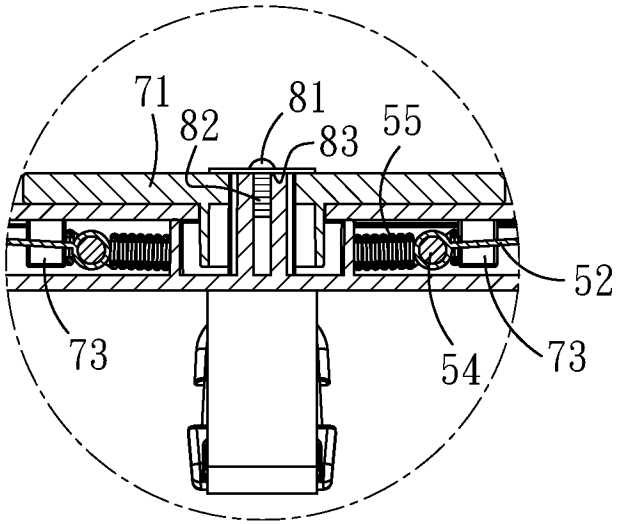
FIG. 8B is an enlarged partial view of circle 8B from FIG. 8A.
Figure 9A:
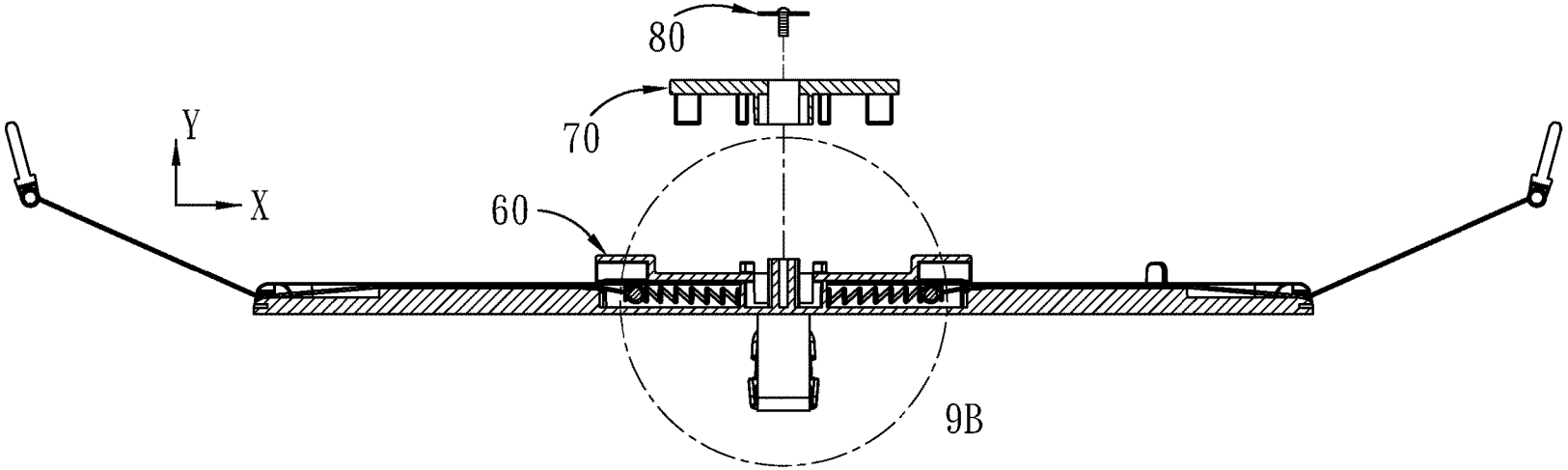
FIG. 9A is a section view that a bounce-control module is removed from a bouncing disc module of FIG. 7.
Figure 9B:
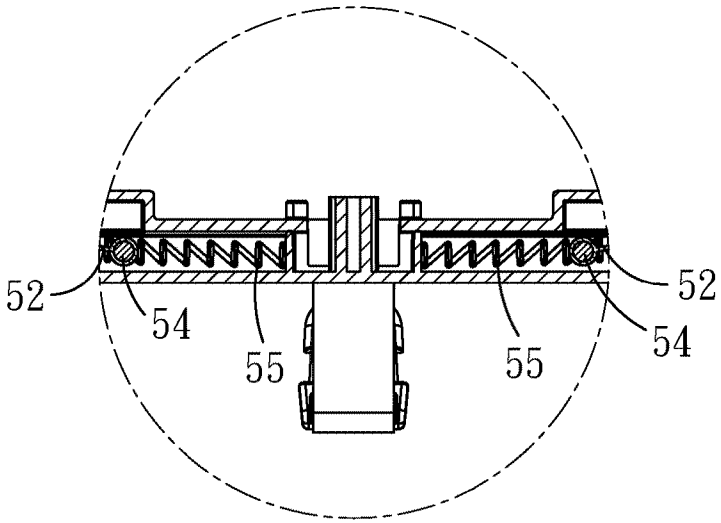
FIG. 9B is an enlarged partial view of circle 9B from FIG. 9A.

Referring to FIG. 7 and FIGS. 8A-B, another embodiment of the baby bouncing chair 100 of the invention is shown. The reset-control elastic element 55 is a tension spring. One end of the reset-control elastic element 55 is provided on the second fixing end 52 of the corresponding one of the plurality of supporting band units 50. An opposite end of the reset-control elastic element 55 is attached to the corresponding one of the at least three limiting grooves 44. The positions of the plurality of limiting through holes 63 of the first cover plate 60 are adjusted according to the positions of the reset-control elastic elements 55 and the limiting rod 54 assembled therewith in the limiting groove 44. The bounce-control module 70 in this embodiment does not have the limiting sliding groove 75 and the control slider 76. Referring to FIGS. 9A-B, when the user requires the baby bouncing chair 100 to be in the bouncing state, the limiting fastening piece 80 and the stop blocks 73 of the second cover plate 71 are removed from the limiting grooves 44. The reset-control elastic elements 55 enable the corresponding limiting rods 54 to move in the corresponding limiting grooves 44. The plurality of supporting band units 50 are driven to enable the bouncing disc module 40 to move up and down.

To sum up, by using the baby bouncing chair 100 of the invention enables a user to select whether the baby bouncing chair 100 is in a state for bouncing or not in a simple way. The baby bouncing chair 100 is in a non-bouncing state when the guide surface 83 of the limiting fastening piece 80 is located on the first positioning surface 763. The baby bouncing chair 100 is in a bouncing state when the guide surface 83 is located on the second positioning surface 765. The first buckling pieces 53 is disassembled from the first assembling pieces 33 and buckled on the second assembling pieces 62 on the first cover plate 60 for easy storage.

What is claimed is:

1. A baby bouncing chair, comprising:

a table comprising a table top surface, a table bottom surface opposite to the table top surface, and a center opening;

a seat unit detachably assembled at the center opening;

a plurality of chair leg units, each of the plurality of chair leg units provided with a top end and a bottom end opposite to the top end, wherein each of the top ends of the plurality of chair leg units is assembled with the table bottom surface;

a bouncing disc module comprising a bouncing disc top surface and a bouncing disc bottom surface opposite to the bouncing disc top surface, wherein a center of the bouncing disc bottom surface is disposed with a limiting column which is protrudly formed and at least three limiting grooves which surround the limiting column;

a plurality of supporting band units, each of the plurality of supporting band units is provided with a first fixing end and a second fixing end, wherein each of the first fixing ends is assembled with one of the plurality of chair leg units, each of the second fixing ends is provided with a limiting rod and a reset-control elastic element which is assembled with the supporting band unit and is adjacent to the limiting rod, and the second fixing ends are respectively provided in the at least three limiting grooves;

a first cover plate, the first cover plate is provided with a first through hole and a plurality of limiting through holes surrounding the first through hole;

a bounce-control module, the bounce-control module is provided with a plurality of stop blocks, and the plurality of stop blocks are slidably arranged in the plurality of limiting through holes; and a limiting fastening piece assembled with the limiting column, the first cover plate and the bounce-control module are arranged between the limiting fastening piece and the bouncing disc module;

wherein the plurality of stop blocks of the bounce-control module penetrate through the plurality of limiting through holes and are provided in the at least three limiting grooves.

2. The baby bouncing chair of claim 1, wherein the first cover plate is assembled on the bounce-control module and is provided with a plurality of second assembling pieces, the plurality of second assembling pieces protrude from the first cover plate, and the plurality of second assembling pieces surrounds the bounce-control module.

3. The baby bouncing chair of claim 1, wherein the reset-control elastic element is a compression spring, the reset-control elastic element sleeves on the second fixing end of one of the plurality of supporting band units, and abuts the limiting rod.

4. The baby bouncing chair of claim 1, wherein the reset-control elastic element is a tension spring, one end of the reset-control elastic element is provided on the second fixing end of one of the plurality of supporting band units, and an opposite end of the reset-control elastic element is attached to one of the at least three limiting grooves.

5. The baby bouncing chair of claim 1, wherein each of the first fixing ends of the plurality of supporting band units is provided with a first buckling piece, each of the plurality of chair leg units is provided with a first assembling piece, and the first buckling pieces are assembled on the first assembling pieces correspondingly.

6. The baby bouncing chair of claim 1, wherein the bounce-control module further comprises a second cover plate and a control slider, the plurality of stop blocks are disposed on a side surface of the second cover plate adjacent to the first cover plate, the second cover plate is provided with a second through hole, a limiting cylindrical wall, a switch-control elastic element and a limiting sliding groove, wherein the limiting sliding groove is provided on another side surface of the second cover plate, the second through hole corresponds to the first through hole, the limiting cylindrical wall protrudes orthogonally from the side surface, the plurality of stop blocks protrude around the limiting cylindrical wall, the switch-control elastic element is provided between the limiting cylindrical wall and the limiting column, the control slider is slidably arranged in the limiting sliding groove and enables the limiting fastening piece to move on the surface of the control slider in a first direction, and the switch-control elastic element enables the bounce-control module to move in a second direction.

7. The baby bouncing chair of claim 6, wherein the control slider is provided with a limiting trench and two guide walls, the limiting trench is formed by penetrating through the control slider along the first direction, and the guide walls are protrudly formed from opposite sides of the limiting trench along the first direction.

8. The baby bouncing chair of claim 6, wherein the limiting fastening piece provides a head and a threaded portion protruding from the head, the threaded portion is fastened on the limiting column, a side facing the threaded portion of the head provides a guide surface, and the guide surface abuts against the control slider.

9. The baby bouncing chair of claim 7, wherein each of the guide walls further comprises a first positioning surface, a connecting surface and a second positioning surface, the connecting surface is arranged between the first positioning surface and the second positioning surface, and a height difference larger than zero is provided between the first positioning surface and the second positioning surface.

10. The baby bouncing chair of claim 9, wherein when the limiting fastening piece abuts against the first positioning surface, the plurality of stop blocks penetrate through the plurality of limiting through holes and block the limiting rod from moving in one of the at least three limiting grooves, and when the limiting fastening piece abuts against the second positioning surface, the plurality of stop blocks are limited in the plurality of limiting through holes.

* * * * *